US005974813A

United States Patent [19]

Jeong

[11] Patent Number: 5,974,813

[45] Date of Patent: Nov. 2, 1999

[54] MULTI-INVERTER TYPE AIR CONDITIONER AND TEST METHOD THEREOF

[75] Inventor: Sang-jin Jeong, Kyungki-Do, Rep. of Korea

[73] Assignee: Samsung Electronics Co., Ltd., Suwon, Rep. of Korea

[21] Appl. No.: 09/082,473

[22] Filed: May 21, 1998

[30] Foreign Application Priority Data

Nov. 29, 1997 [KR] Rep. of Korea ..... 97-64521

[51] Int. Cl.[6] ..... F25B 49/02

[52] U.S. Cl. ..... 62/127; 62/175

[58] Field of Search ..... 62/125, 126, 127, 62/129, 130, 175, 298, 199, 200; 236/94; 165/11.1, 207

[56] References Cited

U.S. PATENT DOCUMENTS 5,495,722 3/1996 Manson et al. ..... 62/127 X
5,522,230 6/1996 Shima et al. ..... 62/127
5,647,223 7/1997 Wada et al. ..... 62/175

*Primary Examiner*—Harry B. Tanner
*Attorney, Agent, or Firm*—Burns, Doane, Swecker & Mathis, L.L.P.

[57] ABSTRACT

A multi-inverter air conditioner includes an outdoor heat exchanger having a refrigeration cycle, and a plurality of indoor heat exchangers connected to the outdoor heat exchanger by pipes and wire arrangements. Each indoor heat exchanger includes a control part for detecting a temperature of the respective pipe arrangement. Each pipe arrangement includes a pipe controller for opening the pipe. The outdoor heat exchanger comprises a control section for actuating the various pipe controllers and control parts for performing a test of the system. The outdoor heat exchanger further includes an input section for enabling a user to input a command signal to initiate the testing procedure, and a display section for displaying results of the test. During a test procedure, the temperatures of all pipe arrangements are detected before and after the refrigeration cycle has been actuated. If no temperature variation is detected in any of the pipe arrangements, the test procedure is terminated and a malfunction signal is displayed.

3 Claims, 6 Drawing Sheets

MULTI-INVERTER TYPE AIR CONDITIONER AND TEST METHOD THEREOF

BACKGROUND OF THE INVENTION

1) Field of the Invention

The present invention relates to a multi-inverter type air conditioner, and more particularly to a multi-inverter type air conditioner which can effectively test the pipe and the wire arrangements between an outdoor unit and a plurality of indoor units, and a test method thereof.

2) Description of the Prior Art

As shown in FIG. 1, a conventional multi-inverter type air conditioner has an outdoor unit 10 and a plurality of indoor units 20*a,* 20*b* and 20*c*. Outdoor unit 10 is connected to indoor units 20*a,* 20*b* and 20*c* through pipe arrangements 30*a,* 30*b* and 30*c* and wires 40*a,* 40*b* and 40*c*. Pipe controllers 50*a,* 50*b* and 50*c* are installed at pipe arrangements pipes 30*a,* 30*b* and 30*c* for opening and closing the pipe arrangements. Test devices 22*a,* 22*b* and 22*c* for testing the pipe arrangements and the wires are installed at indoor units 20*a,* 20*b* and 20*c,* respectively. In the conventional multi-inverter type air conditioner, the pipe arrangements and the wires are tested as follows.

Firstly, in order to test the wire and the pipe arrangement connected with indoor unit 20*a,* the user operates indoor unit 20*a* by driving test device 22*a*. Then, when indoor unit 20*a* sends an operating signal through wire 40*a* to outdoor unit 10, outdoor unit 10 operates so that pipe controller 50*a* is turned on and other pipe controllers 50*b* and 50*c* are turned off. Accordingly, the refrigerant only flows through pipe arrangement 30*a* connected to indoor unit 20*a,* so the user can determine whether or not the pipe arrangement 30*a* and the wire 40*a* are in a normal condition by detecting the temperature of pipe arrangement 30*a*. If the pipe arrangement and wire are found to be in an abnormal condition, the user tests the operating condition of outdoor unit 10. If outdoor unit 10 is found to be operating in the normal condition, the operation of indoor unit 20*a* is stopped and other indoor units 20*b* and 20*c* are tested in the same manner mentioned above. In this manner, the condition of all pipe arrangements and wires between outdoor unit 10 and indoor units 20*a,* 20*b* and 20*c* can be tested.

However, in the conventional multi-inverter type air conditioner, since each indoor unit is provided with a respective test device, an incorrect operation of one or more of the test devices may occur due to a mistake by the user.

In addition, since the operating condition of the outdoor unit is also tested if the wires and pipe arrangements are in an abnormal condition, the test work is inconvenient and a lot of time is required.

SUMMARY OF THE INVENTION

The present invention has been made to overcome the above described problem of the prior art, and accordingly it is an object of the present invention to provide a multi-inverter type air conditioner which can be easily installed and tested.

Another object of the present invention is to provide a method for testing pipe and wire arrangements of the multi-inverter type air conditioner.

To achieve the above objects, the present invention relates to a multi-inverter air conditioner comprising an outdoor heat exchanger having a refrigeration cycle, and a plurality of indoor heat exchangers connected to the outdoor heat exchanger fluidly by respective pipe arrangements and electrically by respective wire arrangements. Each indoor heat exchanger includes a control part for detecting a temperature of the respective pipe arrangement. Each pipe arrangement includes a pipe controller for selectively opening the respective pipe arrangement for permitting refrigerant from the refrigeration cycle to flow therethrough. The outdoor heat exchanger comprises a control section, and input section, and a display section. The control section is connected to the pipe controllers and the control parts of the indoor heat exchangers for opening a selected pipe controller to permit refrigerant to flow through the respective pipe arrangement, and for receiving a detected temperature of the respective pipe arrangement to determine whether the pipe and wire arrangements are in an operative state. The input section is connected to the control section for inputting a command for testing the state of the pipe and wire arrangements. The display section is connected to the control section for displaying a state of the tested pipe and wire arrangements.

The present invention also pertains to a method of testing the pipe and wire arrangements comprising the steps of:

A) obtaining pre-operating temperatures of at least two of the pipe arrangements;

B) actuating the pipe controllers for opening only one of the pipe arrangements for which pre-operating temperatures were obtained in step B;

C) operating the refrigeration cycle in the outdoor heat exchanger;

D) obtaining post operating temperatures of the pipe arrangements for which pre-operating temperatures were obtained in step A, after step C has been performed for a predetermined time period; and E) comparing the pre-operating temperature with the post-operating temperature obtained for each of the pipe arrangements for which such temperatures were obtained in steps A and D, for determining whether a temperature variation occurred in any of such pipe arrangements.

BRIEF DESCRIPTION OF THE DRAWING

The above objects and other advantages of the present invention will become more apparent by describing in detail a preferred embodiment thereof with reference to the attached drawing, in which.

DETAILED DESCRIPTION OF THE PREFERRED EMBODIMENT

Hereinafter, a preferred embodiment of the present invention will be described with reference to the accompanying drawings.

Figure 2:
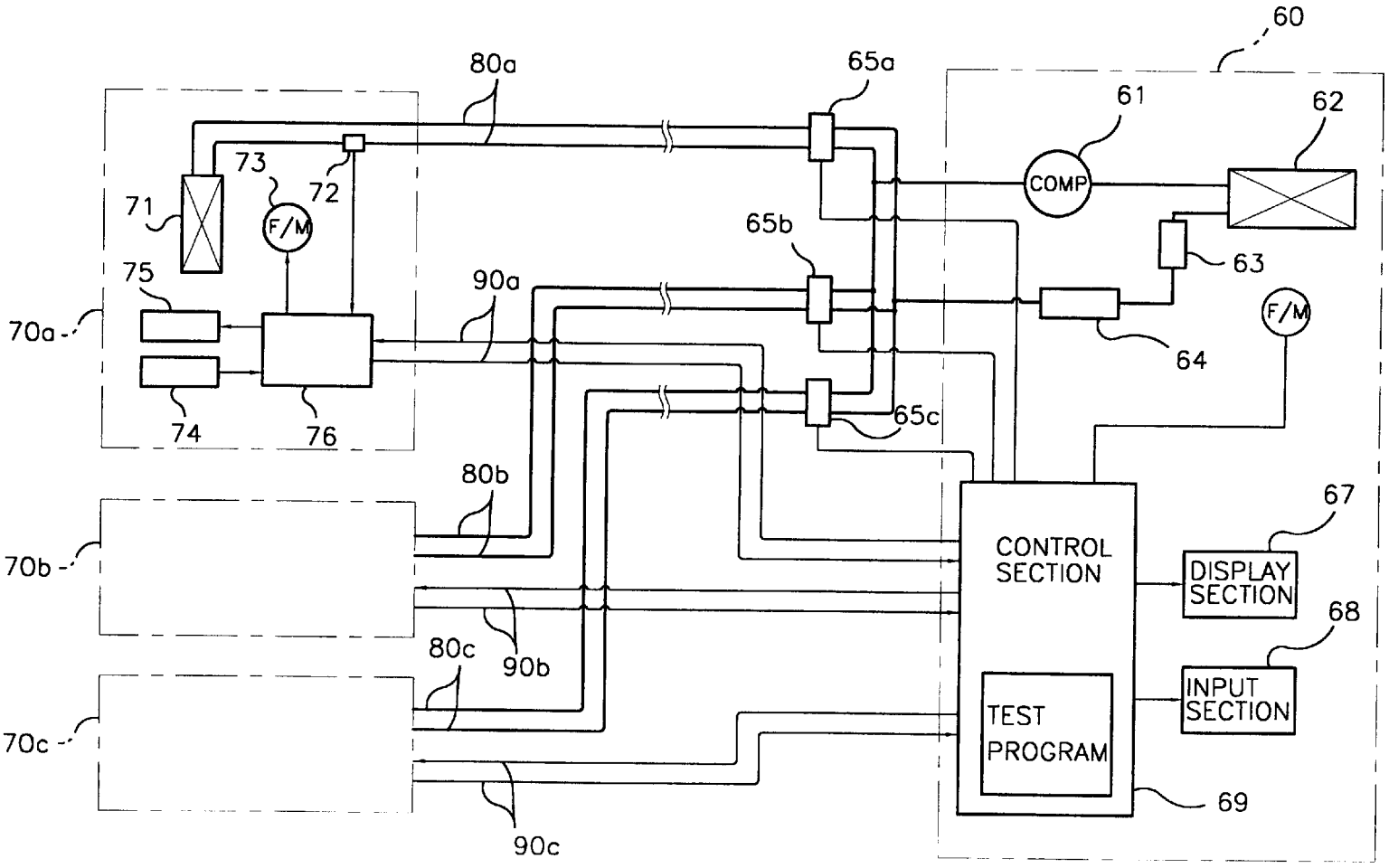
FIG. 2 is a circuit diagram showing a construction of a multi-inverter type air conditioner according to the present invention.

FIG. 2 is a circuit diagram showing a construction of a multi-inverter type air conditioner according to the present invention. Referring to FIG. 2, an outdoor unit 60 is connected to: (i) an indoor unit 70*a* through pipe arrangement 80*a* and wires 90*a;* (ii) an indoor unit 70*b* through pipe arrangement 80*b* and wires 90*b;* and (iii) an indoor unit 70*c* through pipe arrangement 80*c* and wires 90*c*. Each wire includes two A.C. electric lines and a communication line.

Outdoor unit 60 has a compressor 61 which compresses a refrigerant flowing into outdoor unit 60 through each refrigerant inflow pipe of pipe arrangements 80*a*, 80*b* and 80*c* connected to indoor units 70*a*, 70*b* and 70*c*, and a condenser 62 for condensing the compressed refrigerant. The refrigerant is chilled while passing through a drier 63 and a capillary tube 64. Then, the refrigerant is supplied into each refrigerant discharging pipe of pipe arrangements 80*a*, 80*b* and 80*c* through pipe controllers 65*a*, 65*b* and 65*c*, respectively. Here, pipe controller 65*a* controls the amount of the refrigerant supplied into indoor unit 70*a*, pipe controller 65*b* controls the amount of the refrigerant supplied into indoor unit 70*b*, and pipe controller 65*c* controls the amount of the refrigerant supplied into indoor unit 70*c*.

Outdoor unit 60 includes a display section 67 for displaying the condition of the pipe and wire arrangements, an input section 68 for inputting commands for testing the condition of the pipe and wire arrangements, and a control section 69 capable of being communicated with indoor units 70*a*, 70*b* and 70*c*. In addition, when it is required to test the condition of the pipe and the wire arrangements, the refrigerant is caused to flow into a selected indoor unit through a corresponding pipe controller. Then, by detecting the temperature of the selected indoor unit, the condition of the pipe and wire arrangement can be determined. The result is displayed in display section 67 by means of control section 69. Control section 69 includes a microcomputer which carries out the test program.

Indoor unit 70*a* includes an evaporator 71 connected to pipe arrangement 80*a*, a temperature sensor 72 disposed at the refrigerant discharging pipe of pipe arrangement 80*a*, a fan motor 73, an input part 74, a display part 75, and a control part 76. Control part 76 detects the temperature of the refrigerant discharging pipe by temperature sensor 72 and sends the detected temperature information to outdoor unit 60.

Hereinafter, the test procedure of the present invention will be described with reference to FIGS. 3 to 6 wherein the indoor units 70*a*, 70*b*, 70*c* are referred to as A, B and C, respectively.

Figure 3:
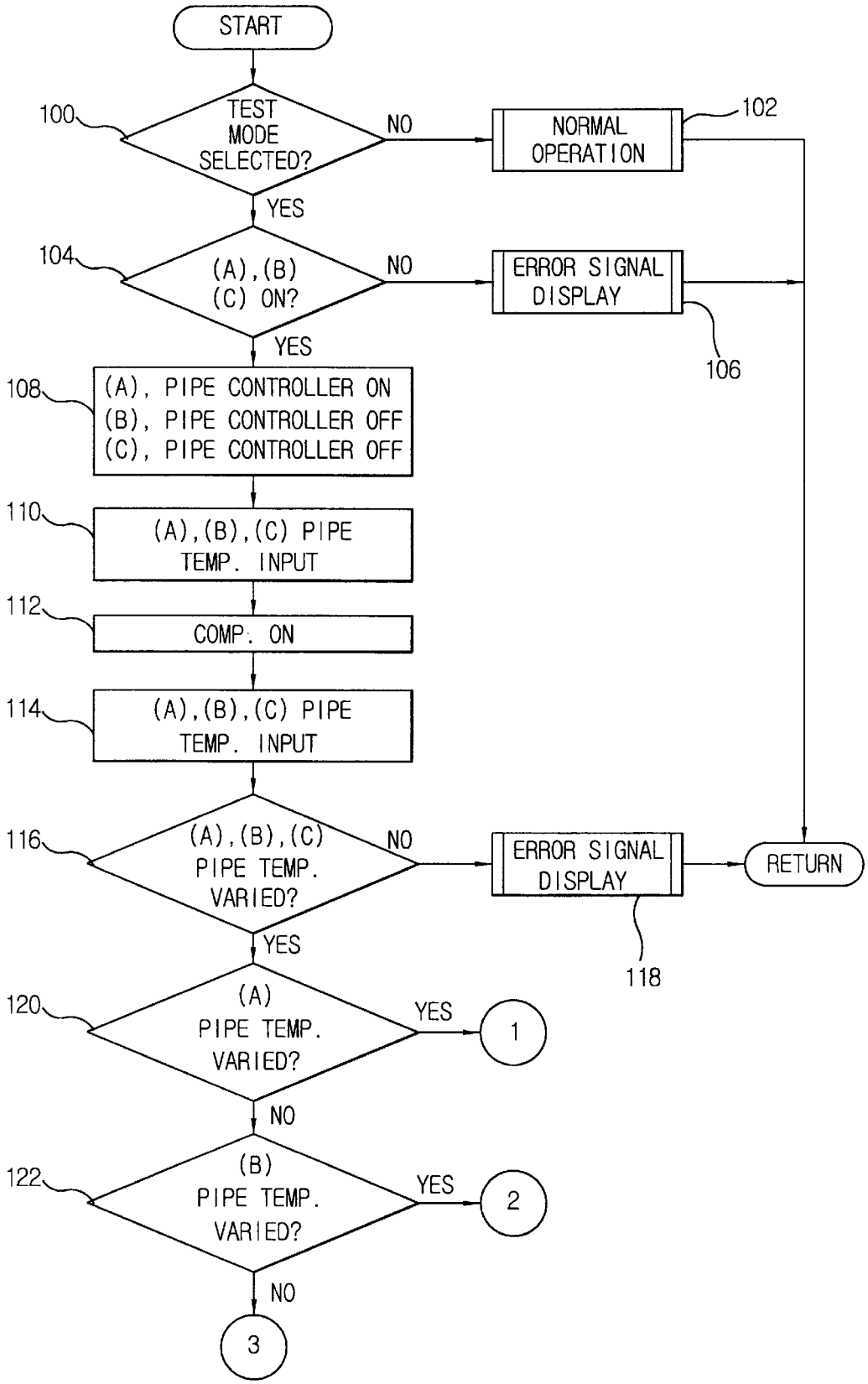
FIGS. 3 to 6 are flow charts for showing procedures for testing pipe/wire arrangements of a multi-inverter type air conditioner according to the present invention.

Referring to FIG. 3, pipe arrangements 80*a*, 80*b* and 80*c* and wires 90*a*, 90*b* and 90*c* are installed between outdoor unit 60 and indoor units (A, B and C) 70*a*, 70*b* and 70*c*. If the electric current is applied to the air conditioner, the system is reset. In this state, when a test mode is selected through input section 68 of outdoor unit 60, control section 69 recognizes it (step S100). If the test mode is not selected, a normal operation is carried out (step S102). When the test mode is selected, control section 69 tests whether all indoor units (A, B and C) 70*a*, 70*b* and 70*c* are turned on (step S104). If all indoor units (A, B and C) 70*a*, 70*b* and 70*c* are turned off, control section 69 determines that the test operation is not prepared, so the control section 69 displays an error signal in display section 67 and the test operation is returned to the initial state (step S106).

In step S104, if indoor units (A, B and C) 70*a*, 70*b* and 70*c* are turned on, control section 69 turns on pipe controller 65*a* and turns off pipe controllers 65*b* and 65*c* so as to initially test only the indoor unit 70*a*, i.e., the refrigerant is able to be circulated only through pipe arrangement 80*a* (step S108). Then, control section 69 forces all of the indoor units (A, B and C) 70*a*, 70*b* and 70*c* to send temperature information about the respective pipe arrangements through the wires and obtains it (step S110).

Control section 69 then operates compressor 61 for a predetermined time, so the chilled refrigerant is circulated through indoor unit 70*a* through pipe arrangement 80*a* (step S112). At this time, control part 76 of indoor unit 70*a* detects the temperature of pipe arrangement 80*a* by means of temperature sensor 72. When a predetermined time lapses, control section 69 forces all of the indoor units 70*a*, 70*b* and 70*c* to send the temperature information about the respective pipe arrangements through the wires and obtains it (step S114).

Figure 1:
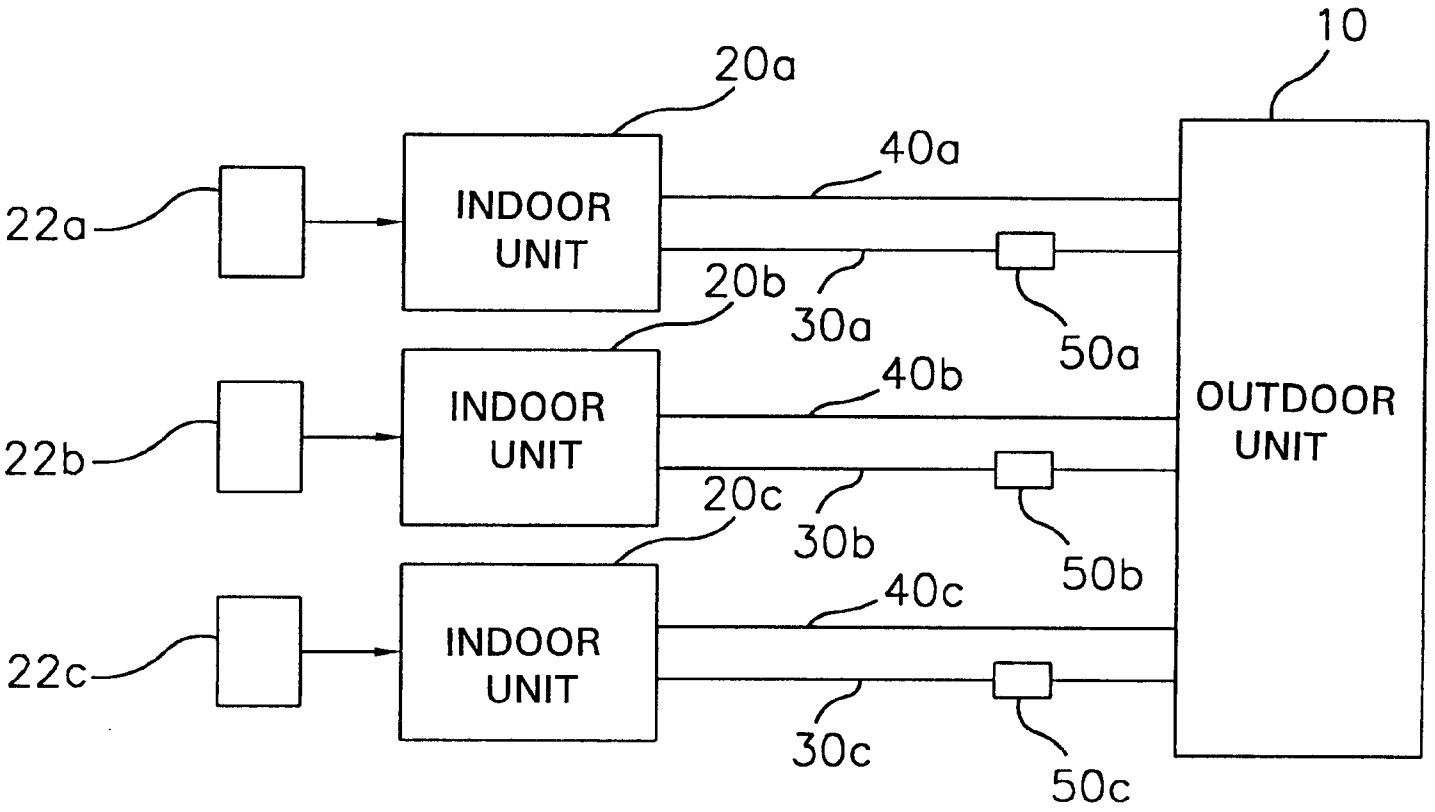
FIG. 1 (PRIOR ART)
FIG. 1 is a block diagram showing the connecting structure between indoor units and an outdoor unit of a conventional multi-inverter type air conditioner.

Then, control section 69 compares the pre-operating temperature information pertaining to all of the pipe arrangements obtained in step S110 (i.e., obtained before circulation of the refrigerant) with the post-operating temperature information pertaining to all of the pipe arrangements obtained in step S114, and determines whether or not a temperature variation is present in any of the pipe arrangements (step S116). In step S116, if the temperature variation is absent from all pipe arrangements ("NO"), an error signal is displayed in display section 67 and the test operation is returned to the initial state (step S118). Thus, even though the compressor has been actuated only once, it is known that none of the pipe arrangements is conducting refrigerant. Such knowledge could not be attained after actuating only one of the controllers 22*a, b, c* in the prior art arrangement of FIG. 1.

Figure 5:
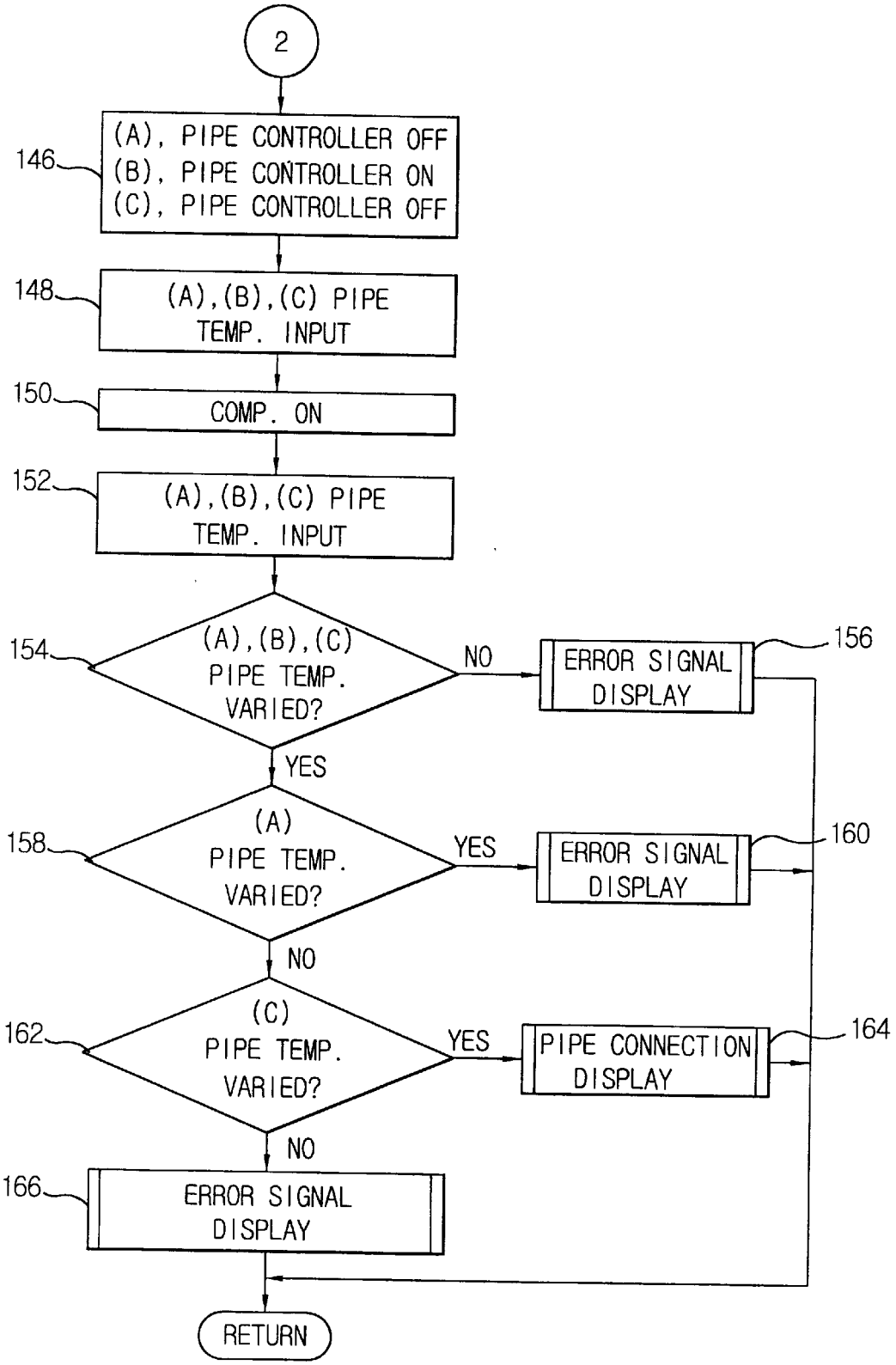
Figure 6:
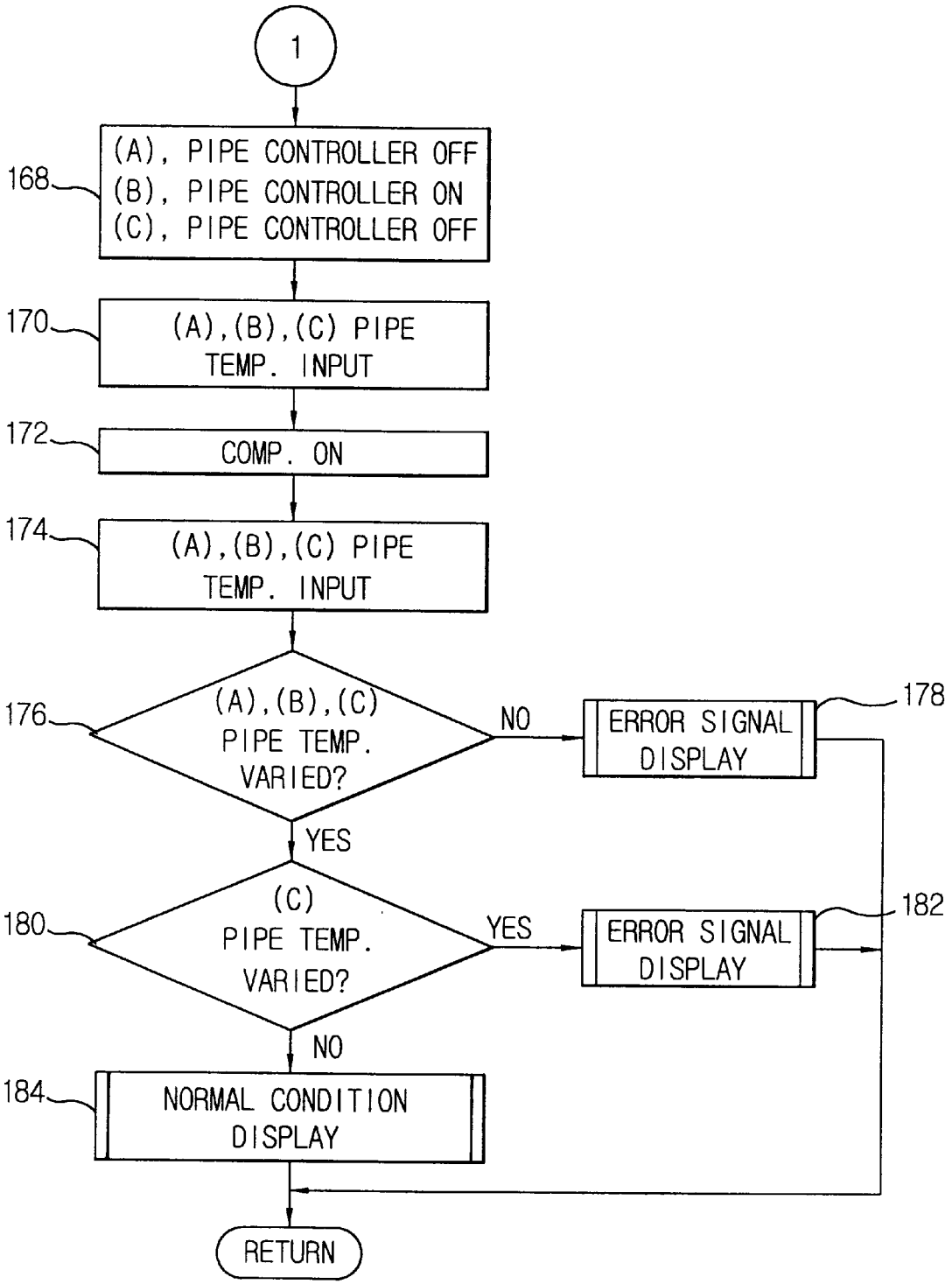

In step S116, if at least one temperature variation is detected, control section 69 tests whether or not the temperature variation of indoor unit (A) 70*a* is present (step S120). In step S120, if a temperature variation is present ("YES"), control section 69 determines that the pipe arrangement of indoor unit (A) 70*a* is in a normal condition, so a test operation of indoor unit (B) 70*b* is carried out (FIG. 6). In step S120, if the temperature variation of indoor unit (A) 70*a* is absent ("NO"), control section 69 tests whether or not a temperature variation of indoor unit (B) 70*b* is present (step S122). In step S122, if a temperature variation is present ("YES"), control section 69 determines that the pipe arrangement of indoor unit (A) 70*a* is in an abnormal condition, so a test operation of indoor unit (B) 70*b* is carried out (FIG. 5). In step S122, if a temperature variation is absent ("NO"), control section 69 determines that the pipe arrangement of indoor unit (A) 70*a* is in an abnormal condition, so a test operation of indoor unit (C) 70*c* is carried out (FIG. 4).

Figure 4:
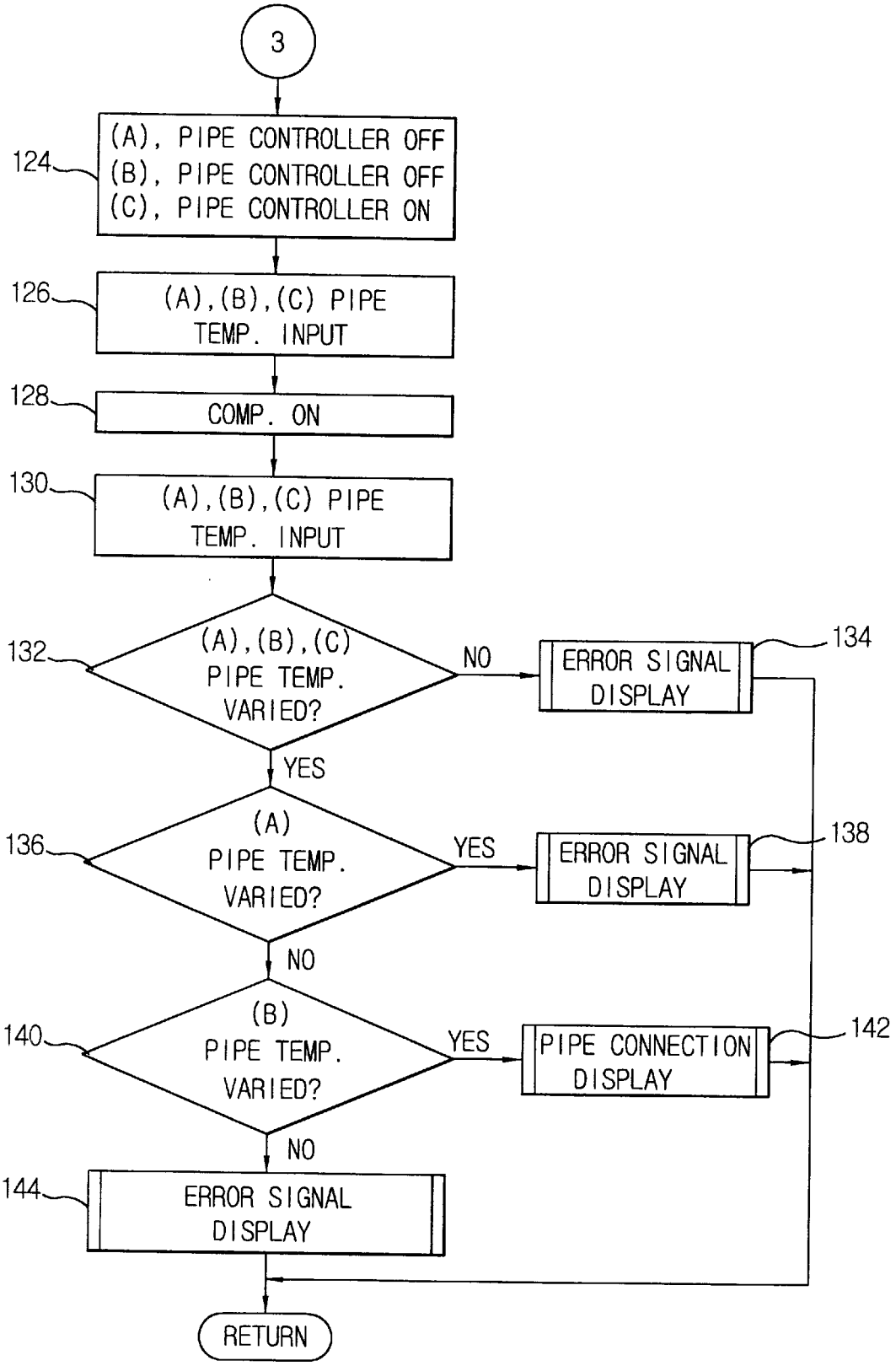

Referring to FIG. 4, in order to determine whether or not the pipe and the wire arrangements of indoor unit (C) 70*c* are in the normal condition, indoor unit (C) 70*c* is selected through input section 68. Then, control section 69 turns on pipe controller 65*c* and turns off pipe controllers 65*a* and 65*b* so as to test indoor unit (C) 70*c*, so the refrigerant can only be circulated through pipe arrangement 80*c* (step S124). In the same manner as in steps S110 to S120, temperature information pertaining to all of the pipe arrangements before and after the operations of respective indoor units (A, B and C) 70*a*, 70*b* and 70*c* is sent to control section 69 where it is stored (steps S126 to S130).

Then, control section 69 compares the pre-operating temperature information obtained in step S126 with the post-operating temperature information obtained in step S130, and determines whether or not any temperature variation is present (step S132). In step S132, if temperature variations are absent ("NO"), an error signal is displayed in display section 67 (step S134) and the test operation is returned to the initial state.

In step S132, if at least one temperature variation is detected ("YES"), control section 69 tests whether or not a temperature variation of indoor unit (A) 70*a* is present (step S136). In step S136, if a temperature variation is present ("YES"), control section 69 determines that the pipe arrangements between indoor unit (A) 70*a* and indoor unit (C) 70*c* have been reversed; that is, the pipe connections of indoor units (A and C) 70*a* and 70*c* should be interchanged so an error signal is displayed in display section 67 (step S130) and the test operation is returned to the initial state. In step S136, if a temperature variation is absent ("NO"), control section 69 tests whether or not a temperature variation of indoor unit (B) 70*b* is present (step S140). In step S140, if the temperature variation is present ("YES"), control section 69 determines that: (i) the pipe arrangement of indoor unit (A) 70*a* is connected to pipe controller 65*b* (ii) the pipe arrangement of indoor unit (B) 70*b* is connected to pipe controller 65*c* and (iii) the pipe arrangement of indoor unit (C) 70*c* is connected to pipe controller 65*a*. That result is displayed in display section 67 (step S142) and the test operation is returned to the initial state. In step 140, if a temperature variation is absent ("NO"), an error signal is displayed in display section 67 (step S144) and the test operation is returned to the initial state.

Thus, even though the compressor has been actuated only twice (steps S112 and S128) either a "YES" answer in step S136 or a "YES" answer in step S140 will reveal the exact details of the incorrect pipe hook-up. In contrast, in the prior art according to FIG. 1, after any two of the controllers have been activated to cause refrigerant to flow through two of the indoor heat exchangers, and the temperature readings in both cases reveal no temperature variations, the precise nature of the incorrect pipe hook-up will not be known.

Referring to FIG. 5, in order to determined whether or not the pipe and the wire arrangements of indoor unit (B) 70*b* are in the normal condition, indoor unit (B) 70*b* is selected through input section 68. Then, control section 69 turns on pipe controller 65*b* and turns off pipe controllers 65*a* and 65*c* to test indoor unit (B) 70*b*, so the refrigerant is able to be circulated only through pipe arrangement 80*b* (step S146). In the same manner as in steps S110 to S130, the temperature information pertaining to all of the pipe arrangements before and after the operation of indoor units (A, B and C) 70*a*, 70*b* and 70*c* is sent to control section 69 where it is stored (step S148 to S152).

Then, in step S152, control section 69 compares the pre-operating temperature information obtained in step 148, prior to the refrigerant circulating operation, with the post-operating temperature information obtained after the operation, and tests whether or not a temperature variation is present (step S154). In step S154, if a temperature variation is absent, an error signal is displayed in display section 67 (step S156) and the test operation is returned to the initial state.

In step S154, if at least one temperature variation is detected, control section 69 tests whether or not a temperature variation of indoor unit (A) 70*a* is present (step S158). In step S158, if the temperature variation is present ("YES"), control section 69 determines that the pipe arrangements between indoor units (A and B) 70*a* and 70*b* have been reversed; that is, the pipe connections of indoor units (A and B) 70*a* and 70*b* should be interchanged, so an error signal is displayed in display section 67 (step S160) and the test operation is returned to the initial state. In step S158, if a temperature variation is absent ("NO"), control section 69 tests whether or not a temperature variation of indoor unit (C) 70*c* is present (step S162). In step S162, if a temperature variation is present ("YES"), control section 69 determines that: (i) the pipe arrangement of indoor unit (A) 70*a* is connected to pipe controller 65*c*, (ii) the pipe arrangement of indoor unit (B) 70*b* is connected to pipe controller 65*a*, and (iii) the pipe arrangement of indoor unit (C) 70*c* is connected to pipe controller 65*b*. The result is displayed in display section 67 (step S164) and the test operation is returned to the initial state. In step 162, if a temperature variation is absent ("NO"), an error signal is displayed in display section 67 (step S166) and the test operation is returned to the initial state.

Referring to FIG. 6, in order to determine whether or not the pipe and the wire arrangements of indoor unit (B) 70*b* are in the normal condition, indoor unit (B) 70*b* is selected through input section 68. Then, control section 69 turns on pipe controller 65*b* and turns off pipe controllers 65*a* and 65*c* so as to test indoor unit (B) 70*b*, so the refrigerant can only be circulated through pipe arrangement 80*b* (step S 168). In the same manner as in steps S110 to S130, the temperature information pertaining to the pipe arrangements before and after the refrigerant-circulating operations of indoor units (A, B and C) 70*a*, 70*b* and 70*c* is sent to control section 69 where it is stored (step S170 to S174).

Then, in step S174, control section 69 compares the pre-operating temperature information obtained in step S170 before the operation, with the post-operating temperature information obtained after the operation and tests whether or not a temperature variation is present (step S176). In step S176, if a temperature variation is absent ("NO"), an error signal is displayed in display section 67 (step S178) and the test operation is returned to the initial state.

In step S176, if at least one temperature variation is detected ("YES"), control section 69 tests whether or not a temperature variation of indoor unit (C) 70*c* is present (step S180). In step S180, if a temperature variation is present ("YES"), control section 69 determines that the pipe arrangements between indoor units (B and C) 70*b* and 70*c* have been reversed; that is, the pipe connections of indoor units (B and C) 70*b* and 70*c* should be interchanged, so an error signal is displayed in display section 67 (step S182) and the test operation is returned to the initial state. In step S180, if a temperature variation is absent ("NO"), a normal condition signal is displayed in display section 67 (step S184) and the test operation is returned to the initial state.

As mentioned above, according to the present invention, since the test device for testing the pipe and the wire arrangements is only installed in the outdoor unit, the number of parts and the manufacturing cost thereof can be reduced, and an incorrect operation of the air conditioner caused by the user can be prevented.

In addition, since all operations for testing the pipe and the wire arrangements are carried out in the outdoor unit, the work is facilitated and the test operation can be rapidly carried out.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A multi-inverter air conditioner comprising an outdoor heat exchanger having a refrigeration cycle, and a plurality of indoor heat exchangers connected to the outdoor heat exchanger fluidly by respective pipe arrangements and electrically by respective wire arrangements, each indoor heat exchanger including a control part for detecting a temperature of the respective of the respective pipe arrangement, each pipe arrangement including a pipe controller for selectively opening the respective pipe arrangement for permitting refrigerant from the refrigeration cycle to flow therethrough, the outdoor heat exchanger comprising:

a control section connected to the pipe controllers and the control parts of the indoor heat exchangers for opening a selected pipe controller to permit refrigerant to flow through the respective pipe arrangement, and for receiving a detected temperature of the respective pipe arrangement to determine whether the pipe and wire arrangements are in an operation state;

an input section connected to the control section for inputting a command for testing the state of the pipe and wire arrangements; and a display section connected to the control section for displaying a state of the tested pipe and wire arrangements.

2. A method of testing pipe and wire arrangements of a multi-inverter air conditioner system which includes an outdoor heat exchanger having a refrigeration cycle, and at least two indoor heat exchangers connected to the outdoor heat exchanger fluidly by respective pipe arrangements and electrically by respective wire arrangements, each pipe arrangement including a pipe controller for selectively opening the respective pipe arrangement for permitting refrigerant from the refrigeration cycle to flow therethrough, the method comprising the steps of:

A) obtaining pre-operating temperatures of at least two of the pipe arrangements;

B) actuating the pipe controller for opening only one of the pipe arrangements for which pre-operating temperatures were obtained in step B;

C) operating the refrigeration cycle in the outdoor heat exchanger;

D) obtaining post-operating temperatures of the pipe arrangements for which pre-operating temperatures were obtained in step A, after step C has been performed for a predetermined time period; and E. comparing the pre-operating temperature with the post-operating temperature obtained for each of the pipe arrangements for which preoperating and post-operating temperatures were obtained in steps A and D, for determining whether a temperature variation occurred in any of such pipe arrangements.

3. A method of testing pipe and wire arrangements of a multi-inverter air conditioner system which includes an outdoor heat exchanger having a refrigeration cycle, and more than two indoor heat exchangers connected to the outdoor heat exchanger fluidly by respective pipe arrangements and electrically by respective wire arrangements, each pipe arrangement including a pipe controller for selectively opening the respective pipe arrangement for permitting refrigerant from the refrigeration cycle to flow therethrough, the method comprising the steps of:

A) obtaining pre-operating temperatures of all of the pipe arrangements;

B) actuating the pipe controller for opening only one of the pipe arrangements;

C) operating the refrigeration cycle in the outdoor heat exchanger;

D) obtaining post-operating temperatures of all of the pipe arrangements after step C has been performed for a predetermined time period; and E) comparing the pre-operating temperature with the post operating temperature obtained for each of the pipe arrangements and displaying an error signal if no temperature variation is determined for any of the pipe arrangements.

* * * * *